US009848662B2

(12) United States Patent
Dinh

(10) Patent No.: US 9,848,662 B2
(45) Date of Patent: Dec. 26, 2017

(54) SYSTEM FOR ATTACHING ARTIFICIAL EYELASHES ON A TAPE STRIP

(71) Applicant: Daniel Phu Dinh, Beverly Hills, CA (US)

(72) Inventor: Daniel Phu Dinh, Beverly Hills, CA (US)

( * ) Notice: Subject to any disclaimer, the term of this patent is extended or adjusted under 35 U.S.C. 154(b) by 0 days.

(21) Appl. No.: 15/060,268

(22) Filed: Mar. 3, 2016

(65) Prior Publication Data

US 2016/0183616 A1 Jun. 30, 2016

Related U.S. Application Data

(63) Continuation of application No. 14/174,601, filed on Feb. 6, 2014, now abandoned.

(60) Provisional application No. 61/761,565, filed on Feb. 6, 2013, provisional application No. 62/127,816, filed on Mar. 3, 2015.

(51) Int. Cl.
*A41G 5/00* (2006.01)
*A41G 5/02* (2006.01)

(52) U.S. Cl.
CPC ..... *A41G 5/02* (2013.01)

(58) Field of Classification Search
CPC ..... A41G 5/02
See application file for complete search history.

(56) References Cited

U.S. PATENT DOCUMENTS

| | | | |
|---|---|---|---|
| 1,831,801 | A | 9/1931 | Birk |
| 1,897,719 | A | 2/1933 | Birk |
| 1,897,747 | A | 2/1933 | Birk |
| 2,079,256 | A | 5/1937 | Kaiser |
| 3,266,500 | A | 8/1966 | Weld |
| 3,516,422 | A | 6/1970 | Bechtold et al. |
| 3,561,458 | A | 2/1971 | Udes |
| 3,566,889 | A | 3/1971 | Cole et al. |
| 3,833,007 | A | 9/1974 | Jacobs |
| 3,880,175 | A | 4/1975 | Hosokawa |
| 3,900,038 | A | 8/1975 | Masters |
| 3,968,807 | A | 7/1976 | Kraicer |
| 4,029,111 | A | 6/1977 | Barton |
| 4,299,242 | A | 11/1981 | Choe |
| D278,086 | S | 3/1985 | Greenberg |
| 5,547,529 | A | 8/1996 | Woolf |
| 6,536,445 | B2 | 3/2003 | Kuroda |

(Continued)

OTHER PUBLICATIONS

Office Action 1 for U.S. Appl. No. 14/174,601, dated Aug. 12, 2014.
Office Action 1 Response for U.S. Appl. No. 14/174,601, dated Nov. 12, 2014.
Office Action 2 for U.S. Appl. No. 14/174,601, dated Jan. 12, 2015.
Office Action 2 Response for U.S. Appl. No. 14/174,601, dated Apr. 13, 2015.

(Continued)

*Primary Examiner* — Rachel Steitz
(74) *Attorney, Agent, or Firm* — Tope-McKay & Associates

(57) ABSTRACT

Described is a system and method for attaching the artificial eyelashes to a tape strip. The system includes an elongated tape strip having at least one surface with an adhesive and having opposing edges that run along a length of the elongated tape strip. A plurality of artificial eyelashes having lash ends are attached with the at least one surface along the length of the elongated tape strip. Further, each of the plurality of artificial eyelashes have physical characteristics such that at least two of the plurality of artificial eyelashes have physical characteristics that are different than one another.

10 Claims, 4 Drawing Sheets

(56) References Cited

U.S. PATENT DOCUMENTS

| | | | | |
|---|---|---|---|---|
| D510,159 | S | 9/2005 | Song | |
| 7,600,519 | B2 | 10/2009 | Dinh | |
| D632,018 | S | 2/2011 | Nguyen | |
| D632,019 | S | 2/2011 | Nguyen | |
| 8,061,367 | B2 | 11/2011 | Rabe et al. | |
| 8,113,218 | B2 | 2/2012 | Nguyen | |
| 8,127,774 | B2 | 3/2012 | Dinh | |
| 8,225,800 | B2 | 7/2012 | Byrne | |
| 2003/0005941 | A1 | 1/2003 | Iosilevich | |
| 2005/0061341 | A1 | 3/2005 | Choe | |
| 2007/0023062 | A1 | 2/2007 | McKinstry et al. | |
| 2007/0272264 | A1 | 11/2007 | Byrne | |
| 2007/0295353 | A1* | 12/2007 | Dinh | A41G 5/02 132/216 |
| 2008/0196732 | A1 | 8/2008 | Merszei | |
| 2009/0217938 | A1 | 9/2009 | Rabe et al. | |
| 2009/0241979 | A1* | 10/2009 | Navarro | A41G 5/02 132/201 |
| 2013/0152960 | A1* | 6/2013 | Pays | A41G 5/02 132/216 |

OTHER PUBLICATIONS

Office Action 3 for U.S. Appl. No. 14/174,601, dated May 29, 2015.
Office Action 3 Response for U.S. Appl. No. 14/174,601, dated Aug. 31, 2015.
Office Action 4 for U.S. Appl. No. 14/174,601, dated Oct. 23, 2015.
Office Action 4 Response for U.S. Appl. No. 14/174,601, dated Jan. 21, 2016.
Office Action 5 for U.S. Appl. No. 14/174,601, dated Mar. 9, 2016.

* cited by examiner

Prior Art
104
103
101
102
108
107
109

Side-view
108
109
103
101

Side-view
108
103
109
101

108
109
103
101

108
109
103
101

108
109
103
101

SYSTEM FOR ATTACHING ARTIFICIAL EYELASHES ON A TAPE STRIP

CROSS-REFERENCE TO RELATED APPLICATIONS

This is a Continuation-in-Part application of Ser. No. 14/174,601, filed on Feb. 6, 2014, which is a non-provisional application U.S. Provisional Application No. 61/761,565, filed on Feb. 6, 2013, entitled, "Lashes on Tape."

This is ALSO a non-provisional application of U.S. Provisional Application No. 62/127,816, filed on Mar. 3, 2015, entitled, "System for attaching artificial eyelashes on a tape strip."

BACKGROUND OF THE INVENTION (1) Field of Invention

The present invention relates to artificial eyelashes and, more particularly, to a system for attaching the artificial eyelashes to a tape strip.

(2) Description of Related Art

Eyelash extensions have been a popular cosmetic enhancement for several years. Eyelash extensions are applied to a user's natural eyelashes to save the user time and enhance their natural beauty.

Currently, there are many types of artificial eyelashes on the market, some better than others. Historically, artificial eyelashes were made of several artificial eyelashes that were adhered to a sticky strip. The sticky strip would then be applied to the user's eyelid to provide many artificial eyelashes in one easy procedure. A problem with the traditional artificial eyelashes is that they are bulky and do not look natural.

With advances in technology, single artificial eyelashes have been conceived. In other words, with single lashes, a single eyelash extension can be glued to a single natural eyelash. By gluing the eyelash extensions directly to the natural eyelashes, the natural look and fullness of the user is enhanced.

A problem with single eyelash extensions is that they are difficult to adhere to packaging for individual use. Traditionally, single eyelash extensions are attached with their ends against and in line with a sticky strip as depicted in FIGS. 1A, 1B, and 3. This is also illustrated with respect to twin-eyelash extensions in FIG. 5. The configuration depicted in FIGS. 1A, 1B, and 3 is the easiest configuration to generate as it allows the manufacture to lay the lashes on the edge of the adhesive strip to provide the end result, which looks nice and is the most easy to manufacture. However, such a configuration does not allow for the ends to protrude from both sides of the tape strip. Importantly, while they look nice, a problem exists because the ends of the eyelash extensions are not clean since the glue on the tape strip may stick to the end (root) of the eyelash extensions when drawn from the tape strip, which affects the ability of the eyelash extension adhesive to properly glue the eyelash extension with the natural lash. In other words, when a user pulls the roots from the tape strip, the roots may have glue that is stuck onto the roots. This glue can create a problem when attempting to apply the eyelash extension adhesive and, further, could inhibit the ability of the eyelash extension adhesive from properly adhering to the user's natural lashes.

Another problem with the prior art is with respect to flared lashes/branched lashes (i.e., many lashes merged together) that are positioned against the tape (in the configuration depicted in FIGS. 1A, 1B, and 3). When there are many lashes merged together, it can be difficult to peel them from the tape or, in some cases, after peeling the branched lashes from the tape the flared lashes separate or break.

Therefore, there is a continuing need for a system for attaching artificial eyelashes on a tape strip such that the artificial eyelashes are easily cleanable and do not separate or break when removed from the tape.

SUMMARY OF INVENTION

The present invention relates to artificial eyelashes and, more particularly, to a system for attaching the artificial eyelashes to a tape strip. The present invention relates to artificial eyelashes and, more particularly, to a system and method for attaching the artificial eyelashes to a tape strip. The system includes an elongated tape strip having at least one surface with an adhesive and having opposing edges that run along a length of the elongated tape strip. A plurality of artificial eyelashes having lash ends are attached with the at least one surface along the length of the elongated tape strip. Further, each of the plurality of artificial eyelashes have physical characteristics such that at least two of the plurality of artificial eyelashes have physical characteristics that are different than one another.

In another aspect, the at least two of the plurality of artificial eyelashes are different colors.

In yet another aspect, the at least two of the plurality of artificial eyelashes are different lengths.

In another aspect, the at least two of the plurality of artificial eyelashes are different shapes.

Additionally, the at least two of the plurality of artificial eyelashes have different curvatures.

In yet another aspect, the at least two of the plurality of artificial eyelashes have different thicknesses.

Further, the artificial eyelashes are attached with the tape strip such that at least one of the artificial eyelashes is attached with the elongated tape strip such that at least one lash end of said at least one artificial eyelash is not, flush with the opposing edges of the elongated tape strip, and wherein at least a portion of the lash ends are freely exposed.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to artificial eyelashes and, more particularly, to a system for attaching the artificial eyelashes to a tape strip. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Introduction

Figures 1A, 1B, 2A, 2B, 2C, 2D:
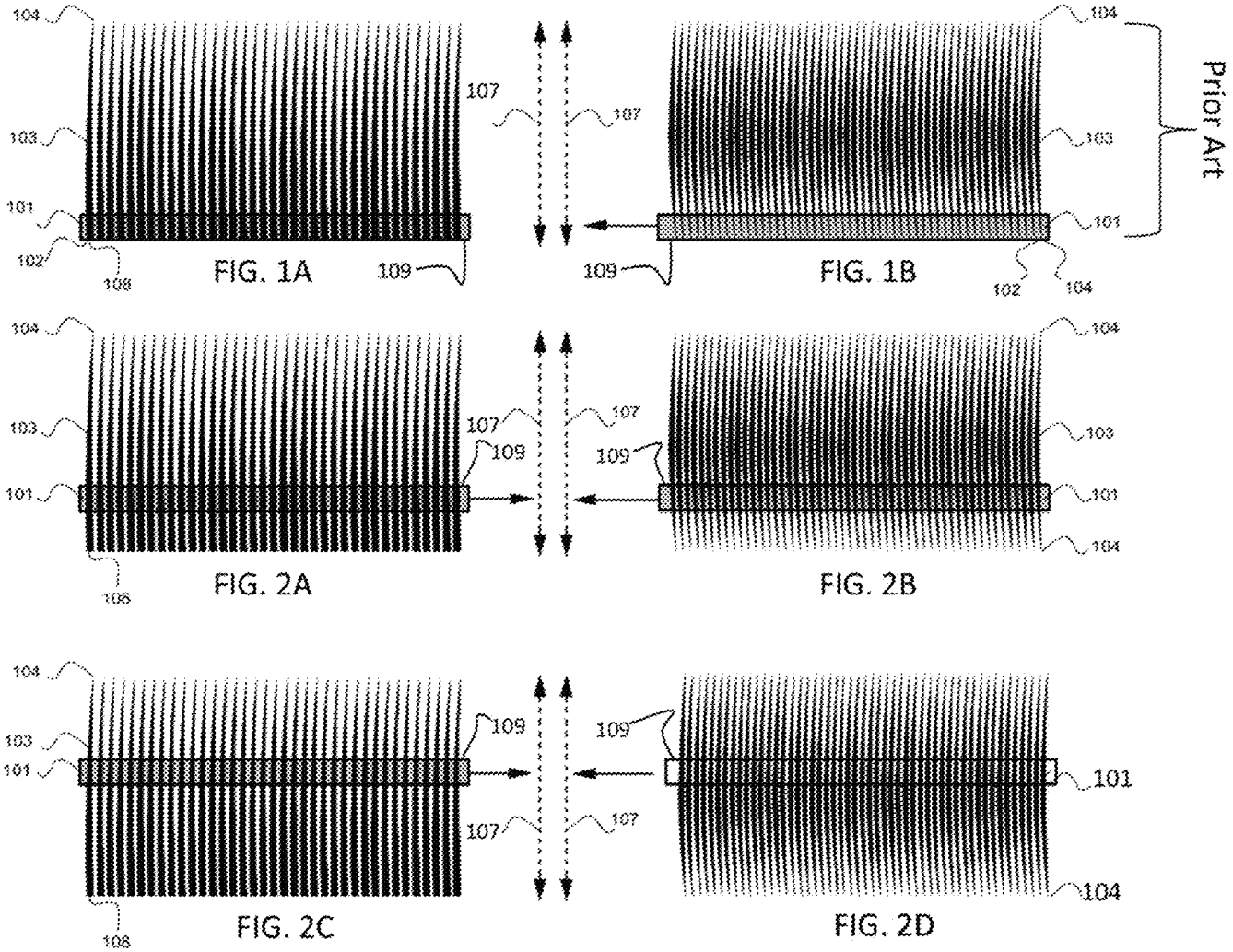
FIG. 1A is a top-view illustration of a technique for affixing artificial eyelash extensions with an adhesive strip according to the prior art, where the end of each artificial eyelash extension is flush with and edge of the adhesive strip.
FIG. 1B is a top-view illustration of a technique for affixing artificial eyelash extensions with an adhesive strip according to the prior art, where the end of each artificial eyelash extension is flush with and edge of the adhesive strip.
FIG. 2A is a top-view illustration of a technique for affixing artificial eyelash extensions with an adhesive strip according to the principles of the present invention.
FIG. 2B is a top-view illustration of a technique for affixing artificial eyelash extensions with an adhesive strip according to the principles of the present invention.
FIG. 2C is a top-view illustration of a technique for affixing artificial eyelash extensions with an adhesive strip according to the principles of the present invention.
FIG. 2D is a top-view illustration of a technique for affixing, artificial eyelash extensions with an adhesive strip according to the principles of the present invention.

The present invention relates to artificial eyelashes and, more particularly, to a system and method for attaching the artificial eyelashes to a tape strip. Traditionally and as shown in the prior art as depicted in FIGS. 1A and 1B, artificial eyelashes 103 are adhered to an elongated tape strip 101 such that an edge 102 (e.g., root) of all of the artificial eyelashes 103 are flush with the edge 109 of the tape strip 101. FIG. 1A depicts lashes 103 with one tapered end 104 and one blunt or cut end 108, while FIG. 1B depicts lashes 103 with two tapered ends 104. As noted above, in both cases, of edges 102 are in line and flush with the edge 109 of the tape strip 101 and are not moved 107 away from the edge 109 of the tape strip 101.

However, such a configuration does not allow for the ends to protrude from both sides of the tape strip. In other words, when a user pulls the roots from the tape strip, the roots may have glue that is stuck onto the roots. This glue can create a problem when attempting to apply the eyelash extension adhesive and, further, could inhibit the ability of the eyelash extension adhesive from properly adhering to the user's natural lashes.

Alternatively, the configuration according to the principles of the present invention and depicted in FIGS. 2A through 2D, 4B, 4D and 5B allows a user to clean the roots of the eyelash extensions before using (while still adhered to the tape strip). In other words, the present invention allows a user to clean the roots (with a cleaning solution, etc.) while the lashes are still adhered to the tape strip.

Another problem with the prior art is with respect to flared lashes/branched lashes (i.e., many lashes merged together) that are positioned against the tape (in the configuration depicted in FIGS. 1A and 1B). When there are many lashes merged together, it can be difficult to peel them from the tape or, in some cases, after peeling the branched lashes from the tape the flared lashes separate or break.

Figures 3, 4A, 4B, 4C, 4D:
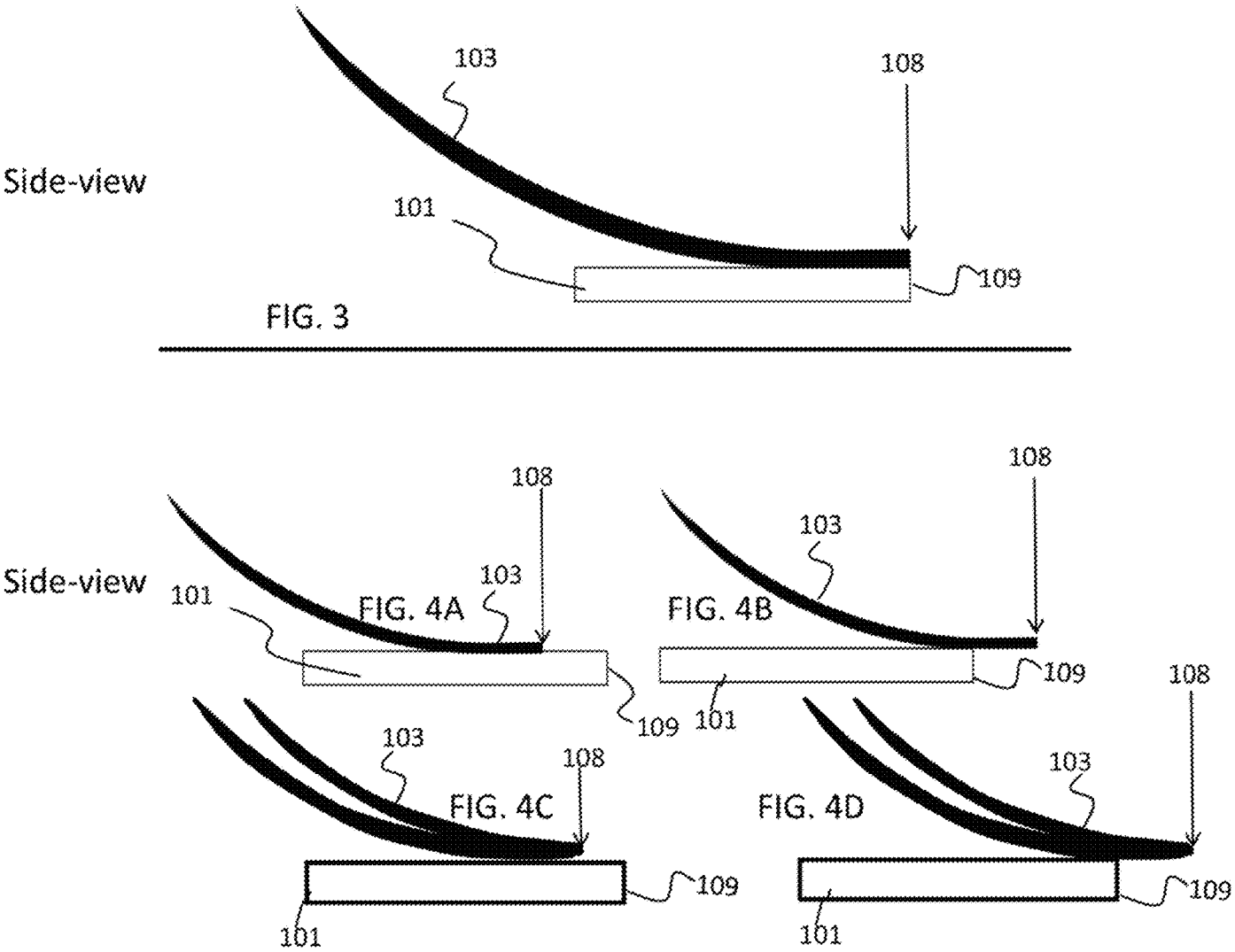
FIG. 3 is a side-view illustration of a technique for affixing artificial eyelash extensions with an adhesive strip, where the end of each artificial eyelash extension is flush with and edge of the adhesive strip.
FIG. 4A is a side-view illustration of a technique for affixing artificial eyelash extensions with an adhesive strip according to the principles of the present invention.
FIG. 4B is a side-view illustration of a technique for affixing artificial eyelash extensions with an adhesive strip according to the principles of the present invention.
FIG. 4C is a side-view illustration of a technique for affixing artificial eyelash extensions with an adhesive strip according to the principles of the present invention.
FIG. 4D is a side-view illustration of a technique for affixing artificial eyelash extensions with an adhesive strip according to the principles of the present invention.

Alternatively, it is easier for a user if the flare lashes/branched lashes are positioned against the tape strip as depicted in FIGS. 4A and 4C because the body of the flare lashes/branched lashes touch the tape less. Therefore, in various embodiments, the present invention provides artificial eyelashes on a tape strip such that the artificial eyelashes extend from both sides of the strip; or one side only, or any combination thereof.

(2) Specific Aspects

In one aspect, the present invention improves upon the prior art by providing artificial eyelash extensions (or any other thin, filament-like item, e.g., hair, strands, etc.) that are adhered to a strip of material (e.g., tape strip, paper strip, foil strip, etc.) such that one or more of the ends are not flush with an edge of the tape strip or are of the same or different lengths, color, shape, curvature and thickness, or any combination of thereof. This concept is depicted throughout FIGS. 2A, 2B, 2C, 2D, 4A, 4B, 4C, 4D, 5A, 5B, and 6, which show how the strip (e.g., elongated tape strip) can be positioned anywhere along the length or body of the lashes and still be within the scope of the present invention. FIGS. 4C and 4D show that the present invention can also be employed with branched lashes.

It should be understood that the present invention is a configuration for packaging, storing, and transporting a collection or plurality of eyelash extensions, in which the eyelash extensions are affixed individually with a tape strip or other adhesive item.

For example, FIGS. 2A through 2D illustrate artificial eyelashes extensions 103 that are attached individually to a tape strip 101. Importantly, the eyelash extensions 103 are affixed with the tape strip 101 such that at least one of (or all) the ends 104 and 108 of the eyelash extensions are not flush or aligned with the edge 109 of the tape strip 101. FIGS. 2A and 2C depict eyelash extensions 103 with one tapered end 104 and one blunt or cut end 108, while FIGS. 2B and 2D depict eyelash extensions 103 with two tapered ends 104. It is noted that the tape strip 101 can be affixed along any point along the length 107 oldie body of the eyelash extensions 103 so long as the ends 104 and 108 are not flush with the edge 109 of the tape strip 101. Thus, the tape strip 101 includes at least one surface with an adhesive and having opposing edges 109 that run along a length of the elongated tape strip 101, with eyelash extensions 103 attached with the at least one surface with the adhesive and along the length of the elongated tape strip 101.

This concept is further illustrated in the side-view illustrations of FIGS. 3, and 4A through 4D. FIG. 3 is a side-view illustration, illustrating the eyelash extension 103 affixed with the tape strip 101 such that an end 108 of the extension 103 is flush with an edge 109 of the tape strip 101. Alternatively, the present invention is depicted in FIGS. 4A through 4D, which illustrate eyelash extensions 103 attached to the tape strip 101 such that the ends 108 of the eyelash extensions 103 are not flush or aligned with an edge 109 of the tape strip 101. It should noted that although the blunt end 108 is depicted, the invention is not intended to be limited thereto as the concept can be equally applied to tapered ends, as illustrated in FIGS. 2B and 2D.

Figure 5A:
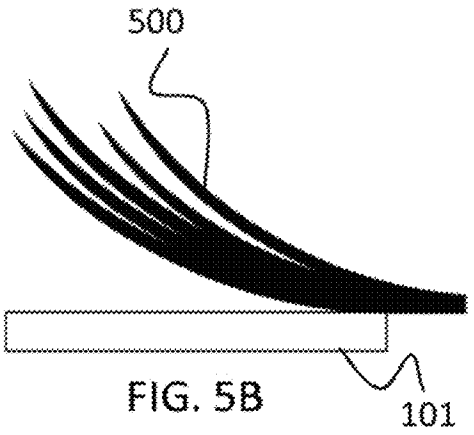
FIG. 5A is a side-view illustration of a technique for affixing artificial eyelash extensions with an adhesive strip according to the principles of the present invention.
Figure 5B:
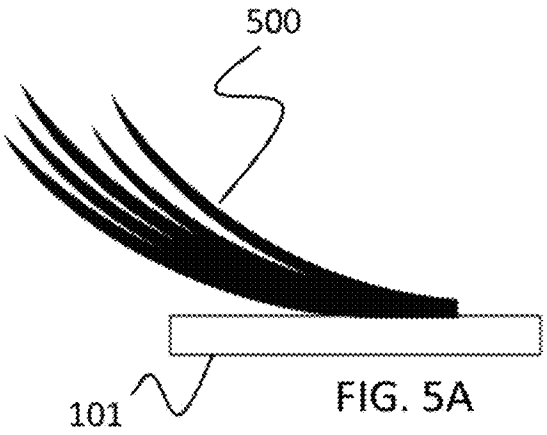
FIG. 5B is a side-view illustration of a technique for affixing artificial eyelash extensions with an adhesive strip according to the principles of the present invention.
Figure 5C:
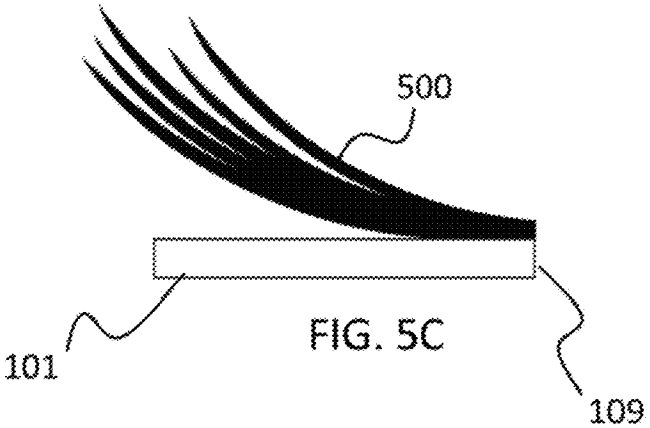
FIG. 5C is a side-view illustration of a technique for affixing artificial eyelash extensions with an adhesive strip according to the principles of the present invention.

It should be noted that the present invention is also directed to all branched lashes that include more than two lashes that branch from to common end. Such branched eyelash extensions 500 can be placed at any location on the adhesive strip 100 (as shown in FIGS. 5A through 5C), including at the edge 109 of the strip 101 as shown in FIG. 5C.

Figure 6:
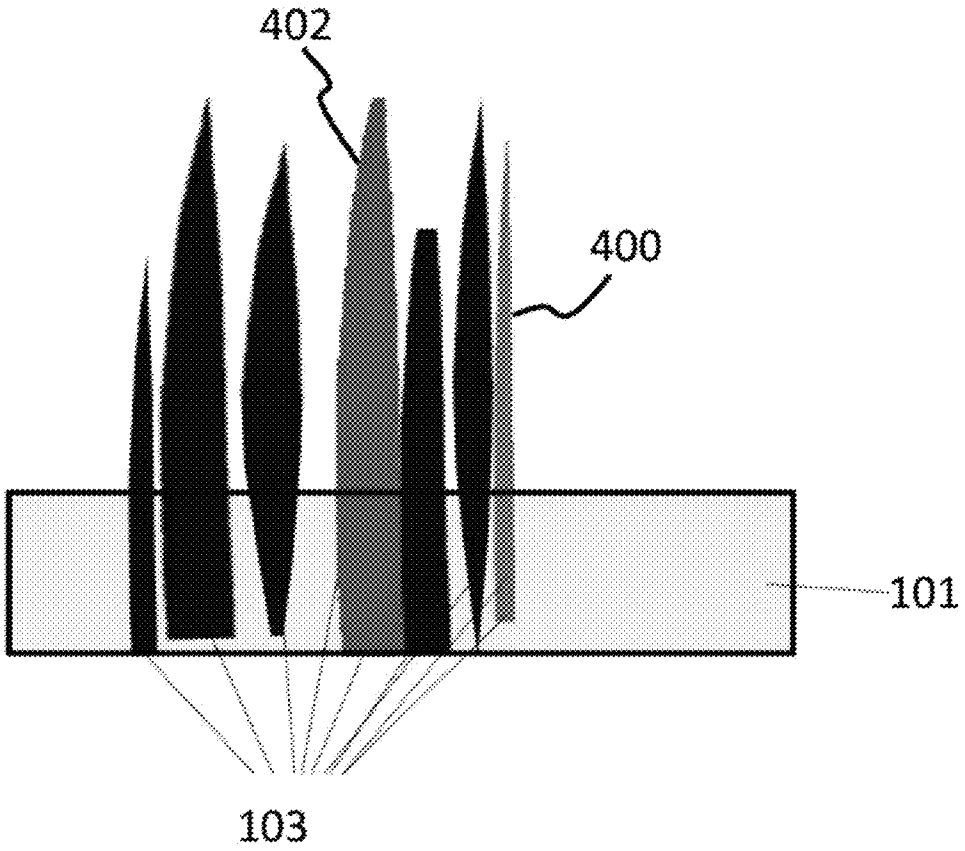
FIG. 6 is an illustration depicting another aspect, where each of the artificial eyelash extensions on the tape strip is the same or different.

In another aspect as shown in FIG. 6, the individual eyelash extensions 103 on the tape strip 101 have physical characteristics such that they can be of any shape, thickness, color, curve, or length, or any combination thereof. Further, the individual eyelash extensions 103 on any given tape strip 101 can each have the same physical characteristics or different physical characteristics or any combination thereof. As a non-limiting example, the individual eyelash extensions 103 can be of different colors, such as pink 400 and blue 402 (as depicted) or any other desired color or combination thereof. By having different physical characteristics on a single tape strip 101, a technician can easily offer the client various aesthetic appearances and retrieve the different eyelash extensions 103 without having to move or change out the tape strip 101 that is currently being used during the application process.

Additionally, the roots (ends) of the eyelash extensions can be flush with the end of the tape (as shown in FIG. 3), or be positioned such that the ends of the eyelash extensions are not flush or aligned with an edge of the tape strip (as shown in FIGS. 4A through 4D), or positioned such that some are flush while others are not, or any combination thereof.

What is claimed is:

1. A system for attaching artificial eyelashes on a strip, comprising:

an elongated tape strip having at least one surface with an adhesive and having opposing edges that run along a length of the elongated tape strip;

a plurality of artificial eyelashes having lash ends attached with the at least one surface along the length of the elongated tape strip, each of the artificial eyelashes having at least two lash ends, with the artificial eyelashes attached with the tape strip such that at least one lash end of a first artificial eyelash is flush with an opposing edge and at least one lash end of a second artificial eyelash is affixed with the elongated strip between the opposing edges;

wherein each of the plurality of artificial eyelashes have physical characteristics such that at least two of the plurality of artificial eyelashes have physical characteristics that are different than one another.

2. The system as set forth in claim 1, wherein the at least two of the plurality of artificial eyelashes are different colors.

3. The system as set forth in claim 2, wherein the at least two of the plurality of artificial eyelashes are different lengths.

4. The system as set forth in claim 3, wherein the at least two of the plurality of artificial eyelashes are different shapes.

5. The system as set forth in claim 4, wherein the at least two of the plurality of artificial eyelashes have different curvatures.

6. The system as set forth in claim 5, wherein the at least two of the plurality of artificial eyelashes have different thicknesses.

7. The system as set forth in claim 1, wherein the at least two of the plurality of artificial eyelashes are different lengths.

8. The system as set forth in claim 1, wherein the at least two of the plurality of artificial eyelashes are different shapes.

9. The system as set forth in claim 1, wherein the at least two of the plurality of artificial eyelashes have different curvatures.

10. The system as set forth in claim 1, wherein the at least two of the plurality of artificial eyelashes have different thicknesses.

* * * * *